US007992494B2

(12) United States Patent
Hurley

(10) Patent No.: US 7,992,494 B2
(45) Date of Patent: Aug. 9, 2011

(54) DETONATOR IGNITION PROTECTION CIRCUIT

(75) Inventor: Eldon K. Hurley, Salt Lake City, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 101 days.

(21) Appl. No.: 12/045,942

(22) Filed: Mar. 11, 2008

(65) Prior Publication Data

US 2008/0223241 A1 Sep. 18, 2008

Related U.S. Application Data

(60) Provisional application No. 60/894,324, filed on Mar. 12, 2007.

(51) Int. Cl.
*F42B 3/18* (2006.01)

(52) U.S. Cl. ..... 102/202.4

(58) Field of Classification Search ..... 102/202.2, 102/204.4

See application file for complete search history.

(56) References Cited

U.S. PATENT DOCUMENTS 2,658,451 A * 11/1953 Horne ..... 102/202.4
3,022,446 A * 2/1962 Irish, Jr. ..... 361/248
3,640,224 A * 2/1972 Petrick et al. ..... 102/202.2
4,769,734 A * 9/1988 Heinemeyer et al. ..... 361/56
4,967,665 A * 11/1990 Baginski ..... 102/202.2
5,179,248 A * 1/1993 Hartman et al. ..... 102/202.4
5,309,841 A * 5/1994 Hartman et al. ..... 102/202.4
7,021,218 B2 * 4/2006 Davis ..... 102/218
7,268,445 B2 * 9/2007 Uono et al. ..... 307/10.1

OTHER PUBLICATIONS

PCT International Search Report; International Application No. PCT/US2008/003241; International Filing Date: Mar. 3, 2008; Mailing Date: Jul. 21, 2008.

PCT Written Opinion of the International Searching Authority; International Application No. PCT/US2008/003241; International Filing Date: Mar. 3, 2008; Mailing Date: Jul. 21, 2008.

* cited by examiner

*Primary Examiner* — Bret Hayes
*Assistant Examiner* — Reginald Tillman, Jr.
(74) *Attorney, Agent, or Firm* — Cantor Colburn LLP

(57) ABSTRACT

An ignition circuit for a detonator is disclosed. The circuit includes; an igniter having a first terminal and an opposing second terminal, a first diode electrically connected in series with the igniter at the first terminal, and a second diode electrically connected in series with the igniter at the second terminal. The first and second diodes each have an anode terminal and a cathode terminal, wherein like terminals of the first and second diodes are electrically connected to the igniter, thereby defining proximal terminals proximate the igniter and distal terminals on an opposing side of each respective diode. An energy source and a switch are electrically connected in series with each other, and are electrically connected across the distal terminals. Current flow through the igniter sufficient to ignite the igniter is prevented until an ignition voltage is applied to the distal terminals that is equal to or greater than the reverse breakdown voltage of the first diode or the second diode.

16 Claims, 3 Drawing Sheets

DETONATOR IGNITION PROTECTION CIRCUIT

CROSS REFERENCE TO RELATED APPLICATIONS

This application claims the benefit of U.S. Provisional Application Ser. No. 60/894,324, filed Mar. 12, 2007, which is incorporated herein by reference in its entirety.

BACKGROUND OF THE INVENTION

The present invention relates to electric and electronic detonators and, more specifically, to such detonators being protected against inadvertent firing by stray or induced electrical currents, magnetic fields and the like.

U.S. Pat. No. 5,179,248 (the '248 patent), issued Jan. 12, 1993 to J. Keith Hartman et al. and entitled "Zener Diode For Protection Of Semiconductor Explosive Bridge", discloses protection of a semiconductor bridge against inadvertent firing by connecting a zener diode across the conductive metal lands forming part of the semiconductor bridge. As explained at column 3, line 14 et seq., a semiconductor bridge device includes a pair of spaced-apart metal lands disposed in ohmic contact on a doped semiconductor layer with a gap between the lands. In response to a voltage or current equal to or in excess of a predetermined level and duration being applied to the gap between the lands, a plasma is formed in the gap with sufficient energy to initiate an explosive disposed in the gap. The device for preventing accidental discharge includes and preferably consists of a zener diode having anode and cathode electrodes respectively connected to the first and second lands of the semiconductor bridge device.

U.S. Pat. No. 5,309,841 (the '841 patent), issued May 10, 1994 to J. Keith Hartman et al. and entitled "Zener Diode For Protection of Integrated Circuit Explosive Bridge", expands on the disclosure of the '248 patent, including disclosure of circuits adding a capacitor and energy source in parallel with the zener diode and incorporating the elements into an integrated circuit.

As disclosed in both the '248 patent (col. 6, line 56 through col. 7, line 7; FIG. 3) and the '841 patent (col. 7, lines 20-39; FIG. 3), protection against premature firing of the semiconductor explosive bridge is accomplished via waveform clipping by the protective zener diode.

While existing protective schemes for detonator devices may be suitable for their intended purpose, there remains, however, a need in the art for improved protective schemes that provide improved protection against possible stray voltage conditions that could cause unplanned initiation of a detonator.

BRIEF DESCRIPTION OF THE INVENTION

An embodiment of the invention includes an ignition circuit for a detonator including; an igniter having a first terminal and an opposing second terminal, a first diode electrically connected in series with the igniter at the first terminal, and a second diode electrically connected in series with the igniter at the second terminal. The first and second diodes each have an anode terminal and a cathode terminal, wherein like terminals of the first and second diodes are electrically connected to the igniter, thereby defining proximal terminals proximate the igniter and distal terminals on an opposing side of each respective diode. An energy source and a switch are electrically connected in series with each other, and are electrically connected across the distal terminals. Current flow through the igniter sufficient to ignite the igniter is prevented until an ignition voltage is applied to the distal terminals that is equal to or greater than the reverse breakdown voltage of the first diode or the second diode.

BRIEF DESCRIPTION OF THE DRAWINGS

Referring now to the drawings, which are meant to be exemplary and not limiting, and wherein like elements are numbered alike in the accompanying Figures.

DETAILED DESCRIPTION OF THE INVENTION

An embodiment of the invention, as shown and described by the various figures and accompanying text, provides a protection scheme for preventing unplanned initiation of a detonator that may be used for seismic exploration, oil/gas well stimulation, or blasting in hazardous environments, while providing sufficient ignition voltage to an igniter upon command without substantially increasing the amount of energy that an energy source must be capable of delivering to the detonator for delayed ignition.

Figure 1:
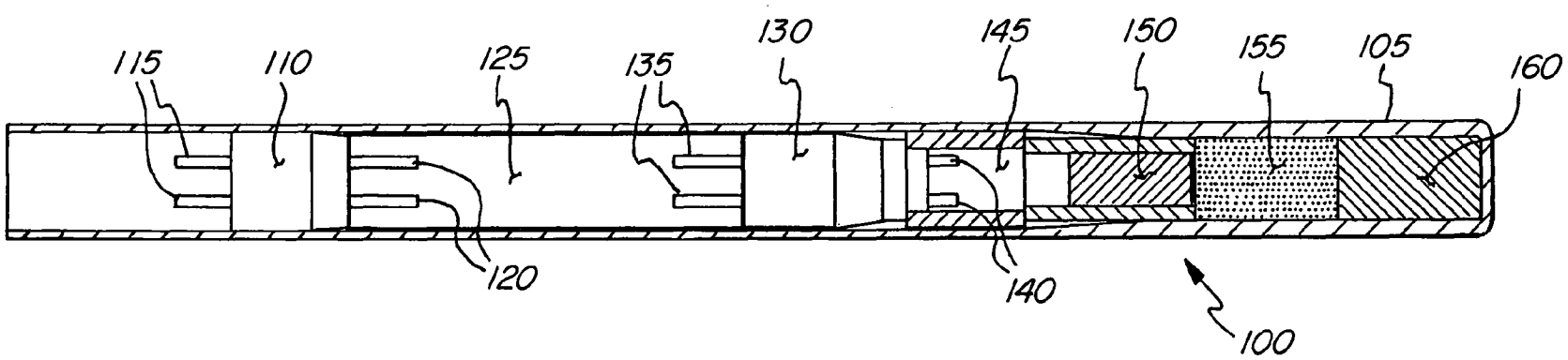
FIG. 1 depicts in cross-sectional schematic view a detonator shell for use in accordance with an embodiment of the invention.

Referring to FIG. 1, an exemplary detonator 100 is depicted in cross-sectional schematic view having a detonator shell 105 that houses an input connector 110 having input pins 115 and output pins 120, a protection circuit 125 (to be discussed in more detail below with reference to FIG. 2), an output connector 130 having input pins 135 and output pins 140, an ignition region 145, a first stage detonator charge 150, a second stage detonator charge 155, and a third stage detonator charge 160. Receipt of a planned ignition voltage at input pins 115 is transferred to protection circuit 125 via output pins 120, which properly passes through protection circuit 125 in a manner to be discussed in more detail below to cause a chain reaction starting with ignition of an igniter 210 (discussed below with reference to FIG. 2) disposed within ignition region 145, which in succession causes firing of the first stage detonator charge 150, the second stage detonator charge 155, and then the third stage detonator charge 160. In an embodiment, the detonator shell 105 is standard commercial detonator shell having a 0.25 inch (6.5 mm) nominal diameter opening, the first stage detonator charge 150 is diazo (diazo dinitro phenol, usually referred to as DDNP), the second stage detonator charge 155 is loose PETN (pentaerythritol tetranitrate, also known as penthrite), and the third stage detonator charge 160 is pressed PETN.

Figure 2:
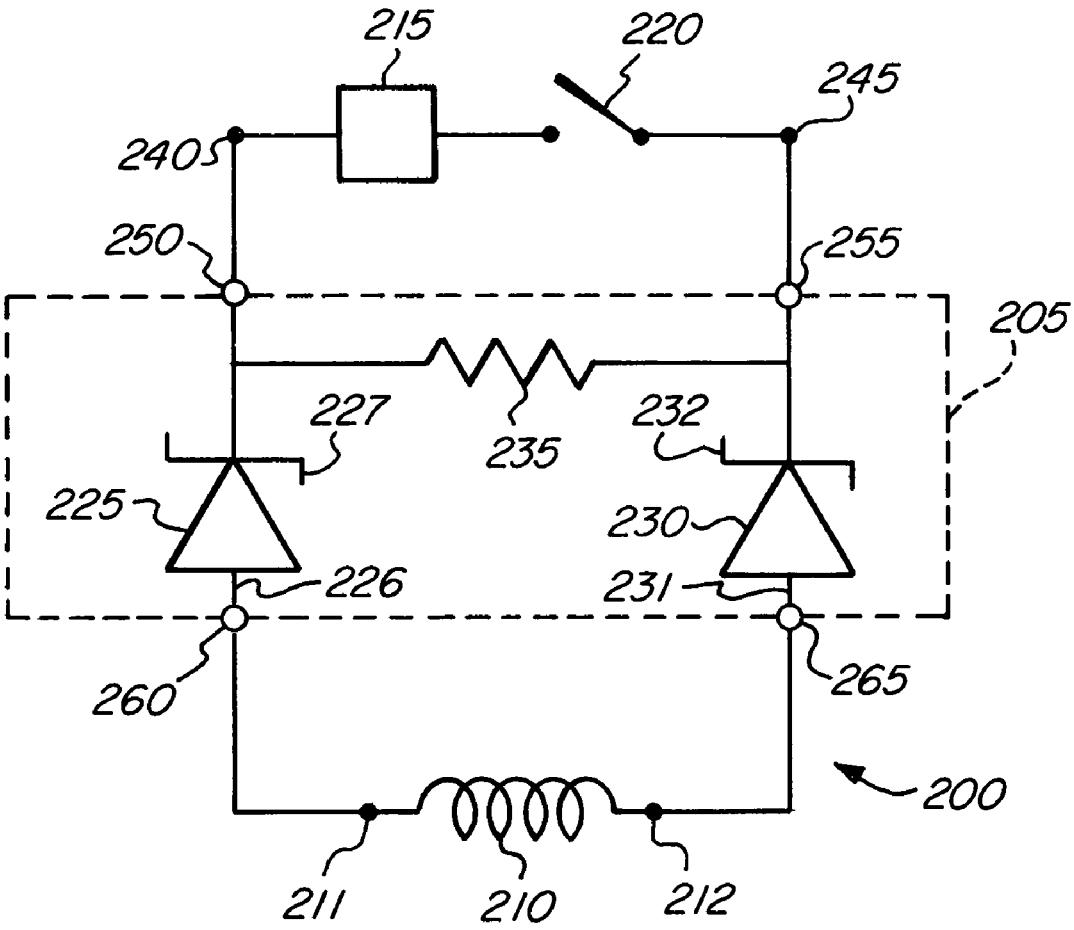
FIG. 2 depicts a schematic of an exemplary firing circuit in accordance with an embodiment of the invention.

Referring now to FIG. 2, an exemplary ignition circuit 200 is depicted having protection circuit 205, an igniter 210 having first 211 and second 212 terminals, a source of electrical energy 215, and a switch 220. In an embodiment, protection circuit 205 includes a first diode 225 having anode 226 and cathode 227, a second diode 230 having anode 231 and cathode 232, and an optional resistor 235. As illustrated, first diode 225 is electrically connected in series with igniter 210 at first terminal 211, and second diode 230 is electrically connected in series with igniter 210 at the opposing second terminal 212, wherein like terminals (anodes 226 and 231 for example) of the first and second diodes 225, 230 are electrically connected to the igniter 210, thereby defining proximal terminals proximate the igniter and distal terminals on an opposing side of each respective diode. As also illustrated, energy source 215 and switch 220 are electrically connected in series with each other, and electrically connected across the distal terminals of first and second diodes 225, 230.

In relating FIG. 2 to FIG. 1, contact points 240, 245 in FIG. 2 are electrically synonymous with input pins 115 in FIG. 1, contact points 250, 255 in FIG. 2 are electrically synonymous with output pins 120 in FIG. 1, contact points 260, 265 in FIG. 2 are electrically synonymous with input pins 135 in FIG. 1, and terminals 211, 212 in FIG. 2 are electrically synonymous with output pins 140 in FIG. 1. While not specifically depicted in FIG. 1, it will be appreciated by the description and illustration disclosed herein that the energy source 215 and switch 220 illustrated in FIG. 2 are connected to pins 115 of detonator 100 in FIG. 1 (synonymous with contact points 240, 245 of FIG. 2), thereby providing the necessary energy, switching means and ignition voltage to fire igniter 210 disposed in ignition region 145. In an embodiment, energy source 215 is a battery, a charged capacitor, or any other energy source suitable for the purposes disclosed herein, and switch 220 is an electronic switching device, or any other switching device suitable for the purposes disclosed herein, where switch 220 is a separate component or integrated within a time delay module.

As mentioned above, resistor 235 may be optionally disposed in electrical connection across the distal terminals of diodes 225, 230, and in parallel with the series-connected energy source 215 and switch 220. When present, resistor 235 provides an electrical path in front of the diodes 225, 230 for pre-testing the integrity of electrical connections from the firing station (not illustrated) up to the protection circuit 205 and igniter 210, and for protecting the circuit 205 against stray static voltages.

In accordance with an embodiment of the invention, current flow through igniter 210 sufficient to ignite igniter 210 is prevented until an ignition voltage is applied to the distal terminals (250, 255 for example) of diodes 225, 230 that is equal to or greater than the reverse breakdown voltage of the first diode 225 or the second diode 230.

In an embodiment, the first and second diodes 225, 230 are zener diodes having the same reverse breakdown voltage rating of 20 Volts, and are disposed such that their anodes 226, 231 are the proximal terminals (that is, anodes 226, 231 are electrically connected to igniter 210).

In another embodiment, first and second diodes 225, 230 are zener diodes having the same reverse breakdown voltage rating of 200 Volts.

Figure 3:
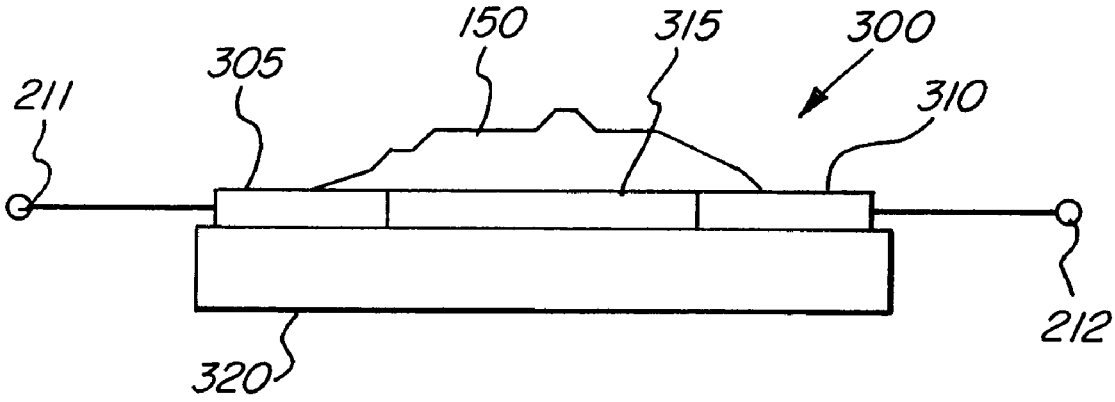
FIG. 3 depicts an alternate igniter to that depicted in FIG. 2 for use in accordance with an embodiment of the invention.

In an embodiment, igniter 210 is a bridgewire designed for contact with (for example, to be embedded within) an explosive device (for example, the first stage detonator charge 150) with a pair of lead wires extending from the bridgewire. However, it will be appreciated that other igniters suitable for the purposes disclosed herein may be employed in place of the bridgewire, such as a semiconductor bridge 300 for example, generally depicted in FIG. 3, having lands 305, 310 in electrical contact with a semiconductor layer 315, all disposed on a substrate 320, with the first stage detonator charge 150 being disposed across lands 305, 310 and semiconductor layer 315. Operation of such a semiconductor bridge 300 in the field of explosive detonators is well known in the art and is not discussed further herein.

In an embodiment, first diode 225, second diode 230, and optional resistor 235 are all surface mounted on a circuit board, generally depicted by reference numeral 205 and the associated dashed-line graphical box depicted in FIG. 2. The combination of circuit board 205 with surface-mounted diodes 225, 230 and resistor 235 (collectively referred to as surface-mounted components) is so dimensioned as to be insertable through the space defined by the opening of detonator shell 105, which in an embodiment is a standard commercial detonator shell having a 0.25 inch (6.5 mm) nominal diameter opening. When the circuit board with surface-mounted components is positioned within the detonator shell, the dielectric breakdown voltage between any of the surface-mounted components and the interior wall of the detonator shell is greater than the reverse breakdown voltage of each of the first diode 225 and the second diode 230.

Upon closure of the switch 220 (planned ignition), not only does the energy source 215 have sufficient energy to generate a voltage at the distal terminals 250, 255 in excess of the reverse breakdown voltage of the first diode 225 or the second diode 230 to generate sufficient current flow to ignite the igniter 210, but also the energy source 215 further has sufficient energy to permanently damage a reverse-biased one of the first and second diodes 225, 230. Since the detonator 100 is an intended self-destructive device, there is no need for either diode 225, 230 to be designed for passing a reverse-biased current without damage thereto. As such, diodes having a reverse-biased current rating far below the actual current passed are fully sufficient for the purposes disclosed herein, thereby permitting small diodes to be used in a compact design for the protection circuit 205.

In an embodiment and in the event of the switch 220 being closed, the energy source 215 has sufficient energy to generate an ignition voltage to ignite the igniter 210 that is equal to or greater than 1.1 times the reverse breakdown voltage of either of the first diode 225 and the second diode 230. And, in the event of the switch 220 being open, each of the first 225 and second 230 diodes have a reverse breakdown voltage sufficient to prevent the igniter 210 from firing upon the occurrence of a stray voltage at the distal terminals (250, 255 for example) less than the reverse breakdown voltage of the associated reverse-fed diode.

While embodiments of the invention have been described herein employing a circuit board 205 with diodes 225, 230 and resistor 235 surface-mounted thereon, it will be appreciated that other packaging arrangements can be employed for the purposes disclosed herein, such as integrally molding diodes 225, 230 and resistor 235 into a plug, again generally depicted by reference numeral 205 and the associated dashed-line graphical box depicted in FIG. 2, where the plug 205 with the integrally-molded diodes 225, 230 and resistor 235 is so dimensioned as to be insertable through the space defined by the opening of a standard size 0.25 inch (6.5 mm) diameter detonator shell 105.

While embodiments of the invention have been described herein having anodes 226, 231 of first diode 225 and second diode 230, respectively, being connected to igniter 210, it will be appreciated that the scope of the invention also covers an arrangement where both diodes are reversed such that their cathodes 227, 232 are connected to igniter 210, as long as both diodes are oriented in the same direction such that no current will flow through igniter 210 if an unplanned voltage below the diode breakdown voltage is applied across the contact points 250, 255 of circuit 205.

An example of the circuit illustrated in FIG. 2 was built utilizing 20-volt zener diodes for diodes 225 and 230, a 68 kilo-ohm resistor for resistor 235, and a standard bridgewire utilized in a superseismic detonator manufactured by Dyno Nobel Inc. of Salt Lake City, Utah, for igniter 210.

A series of tests were conducted in which different levels of voltages were applied to the circuit across contact points 240, 245. All of the tests were carried out by supplying power (energy source 215 for example) from a 250 micro Farad capacitor charged to the voltage specified in Table-1 below, which tabulates the test results.

TABLE 1

| Test No. | Voltage (in Volts) Did Not Fire | Fired |
|---|---|---|
| 1 | 10 | 36 |
| 2 | 15, 19 | 24 |
| 3 | 10, 15, 19 | 22 |
| 4 | 19, 19.8, 20.5 | 28 |
| 5 | 19 | 22 |
| 6 | 19.5, 20, 21.7 | 22 |
| 7 | 21 | 22 |
| 8 | 21 | 22 |
| 9 | 21, 21.7 | 29.5 |
| 10 | 20, 21, 21.7 | 21.9 |

As shown by the data of Table-1, application of test voltages below, or even slightly in excess of, the 20-volt rating of the zener diodes precluded firing of the bridgewire. For example, voltages as high as 19 volts (tests 2 and 3), 19.8 and 20.5 volts (test 4), 19.5, 20 and 21.7 volts (test 6) and 20, 21 and 21.7 volts (tests 7-10) all failed to fire the bridgewire. On the other hand, voltages more significantly above the 20-volt rating of the zener diode provided consistent firing. For example, tests 3 and 5-8 showed firing at 22 volts. Test 10, which showed no firing at 21.7 volts, showed that firing occurred at 21.9 volts. Significantly higher voltages such as 36 volts (test 1) and 29.5 volts (test 9) were successful. The test data clearly show the reliability of the zener diode protecting the bridgewire from firing even at voltages as high as 21.7 volts.

Because diodes 225 and 230 are oriented in the same direction as illustrated in FIG. 2, that is, the diodes face each other in their forward directions, current flow is precluded by a voltage applied across the circuit at contact points 240, 245, until and unless the voltage exceeds the breakdown voltage of the diodes. Once the brealkdown voltage is exceeded, current would then flow to energize the bridgewire.

If zener diodes are utilized as the diodes 240, 245, their breakdown voltage can be precisely specified and a specific all fire/no fire value can readily be established for the diodeprotected detonator by utilizing methods and calculations well known to those skilled in the art. As discussed above, the facing diodes, for example, facing zener diodes, together with the other circuit components, can readily be positioned on a small board or molded into a plug, either of which will readily fit into the inside diameter, about 0.25 inches (6.5 mm), of a standard commercial detonator shell. The disclosed detonator is resistant to stray current engendered by radio frequency energy, static and any other electrical power that does not exceed the diode breakdown voltage.

It is contemplated that in an embodiment where first and second diodes 225, 230 are zener diodes each having a reverse breakdown voltage of 200 Volts, sufficient protection of igniter 210 will be provided against a standard 120 VAC-rms voltage at input pins 115 having a peak voltage of about 170 Volts. By employing zener diodes having a 200 Volt reverse breakdown voltage (first and second diodes 225, 230 in the contemplated embodiment) and a very small current rating (less than 2 milliamps for example), a massive energy pulse of 4-8 joules from a 400 Volt capacitor discharge firing system will result in a one-time use of diodes 225, 230, which will fail in conduction mode. Since diodes 225, 230 need to work only once, such an occurrence of failure in the conduction mode is perfectly acceptable for the purposes disclosed herein. An exemplary commercially available zener diode suitable for the purposes disclosed herein is part number 1SMB5956BT3G manufactured by Oakley Telecom, LC, having a nominal reverse zener voltage of 200 volts at a reverse current of 1.9 milliamps.

The accuracy of the timing of initiation of individual explosive charges in a multiple-charge blasting system must be closely controlled to achieve the desired fragmentation of ore and rock, and to reduce the influence of the blast on structures outside the blast zone. The accuracy of timing of the initiation of individual charges controls the effectiveness of the blast by providing the required distribution of blast induced shockwaves. Embodiments of the invention provide detonators that can be used for closely controlling the timing of the initiation of individual explosive charges in multiple-explosive charge blast operations. For example, for electronic delay of detonator 100, the test voltage provided to contact points 250, 255 of ignition circuit 200 could be safely raised to a level just below the breakdown voltage of diodes 225, 230 without concern of prematurely firing the very low energy igniter 210, thereby enabling better communication with other connected detonators within the multiple-charge blasting system. Additionally, and contrary to other blasting systems that employ a series-connected resistor to protect the igniter, which inherently results in an $I^2R$ power loss across the series-connected resistor during ignition, embodiments of the invention do not have such a power loss and therefore have more energy available from energy source 215 for use by electronic delay circuitry, communications, and controls of the blasting system.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An ignition circuit for a detonator, comprising:

an igniter having a first terminal and an opposing second terminal;

a first diode electrically connected in series with the igniter at the first terminal;

a second diode electrically connected in series with the igniter at the second terminal;

the first and second diodes each having an anode terminal and a cathode terminal, wherein like terminals of the first and second diodes are electrically connected to the igniter, thereby defining proximal terminals proximate the igniter and distal terminals on an opposing side of each respective diode;

an energy source and a switch electrically connected in series with each other, and electrically connected across the distal terminals;

a resistor electrically connected across the distal terminals and in parallel with the series-connected energy source and switch;

the first and second diodes being electrically connected to the igniter in such a manner that results in a current flow through the igniter in response to a current flow through the first and second diodes for all voltage conditions at the distal terminals that produces a current flow through the first and second diodes, the current flow through the igniter being the same as the current flow through the first and second diodes;

wherein current flow through the igniter sufficient to ignite the igniter is prevented until an ignition voltage is applied to the distal terminals that is equal to or greater than the reverse breakdown voltage of the first diode or the second diode.

2. The ignition circuit of claim 1, wherein the first and second diodes are zener diodes.

3. The ignition circuit of claim 1, wherein the first and second diodes have a same reverse breakdown voltage.

4. The ignition circuit of claim 1, wherein the anode terminals of the first and second diodes are the proximal terminals.

5. The ignition circuit of claim 1, wherein the igniter comprises a bridgewire.

6. The ignition circuit of claim 1, wherein the igniter comprises a semiconductor bridge.

7. The ignition circuit of claim 1, wherein the first and second diodes are zener diodes having a same reverse breakdown voltage.

8. The ignition circuit of claim 1, further comprising:

a circuit board having the first and second diodes surface mounted thereon;

wherein the circuit board with the surface-mounted diodes is so dimensioned as to be insertable through the space defined by the opening of a standard size one-quarter inch diameter detonator shell.

9. The ignition circuit of claim 8, wherein the dielectric breakdown voltage between the surface-mounted diodes and the interior wall of the detonator shell is greater than the reverse breakdown voltage of each of the first diode and the second diode.

10. The ignition circuit of claim 9, wherein the resistor is surface mounted on the circuit board.

11. The ignition circuit of claim 1, wherein upon closure of the switch the energy source has sufficient energy to generate a voltage at the distal terminals in excess of the reverse breakdown voltage of the first diode or the second diode, and to generate sufficient current flow to ignite the igniter.

12. The ignition circuit of claim 11, wherein upon closure of the switch the energy source further has sufficient energy to permanently damage a reverse-biased one of the first and second diodes.

13. The ignition circuit of claim 11, where in the event of the switch being closed the energy source further has sufficient energy to generate an ignition voltage to ignite the igniter that is equal to or greater than 1.1 times the reverse breakdown voltage of either of the first diode and the second diode.

14. The ignition circuit of claim 13, where in the event of the switch being open each of the first and second diodes have a reverse breakdown voltage sufficient to prevent the igniter from firing upon the occurrence of a stray voltage at the distal terminals equal to or less than the reverse breakdown voltage of the associated reverse-fed diode.

15. The ignition circuit of claim 1, further comprising:

a plug having the first and second diodes integrally molded therein;

wherein the plug with the integrally-molded diodes is so dimensioned as to be insertable through the space defined by the opening of a standard size one-quarter inch diameter detonator shell.

16. The ignition circuit of claim 1, wherein each of the first diode and the second diode have a reverse breakdown voltage of 200 volts.

* * * * *